United States Patent [19]

Killy

[11] 4,396,143

[45] Aug. 2, 1983

[54] MULTIPLE ARTICLE BEVERAGE PACKAGE

[75] Inventor: Earl J. Killy, Gainesville, Fla.

[73] Assignee: Manville Service Corporation, Denver, Colo.

[21] Appl. No.: 298,125

[22] Filed: Aug. 31, 1981

[51] Int. Cl.[3] ..... B65D 5/72

[52] U.S. Cl. ..... 229/17 B; 206/427; 206/607

[58] Field of Search ..... 229/17 B, 17 R, 17 S, 229/20, 11, 7 R; 206/146, 155, 629, 628, 427, 434, 430, 435, 607; 221/83, 89, 303-306

[56] References Cited

U.S. PATENT DOCUMENTS

| | | | |
|---|---|---|---|
| 1,898,056 | 2/1933 | Johnson | 229/17 B |
| 3,237,837 | 3/1966 | Vizethann | 229/17 B |
| 3,335,940 | 8/1967 | Dykes | 229/17 B |
| 3,356,279 | 12/1967 | Root | 229/17 B |
| 3,894,681 | 7/1975 | Arneson et al. | 229/17 B |
| 4,175,675 | 11/1979 | Maisonneuve | 229/11 X |
| 4,364,509 | 12/1982 | Holley, Jr. et al. | 229/17 B |

*Primary Examiner*—Steven M. Pollard
*Assistant Examiner*—Bryon Gehman
*Attorney, Agent, or Firm*—R. M. Halvorsen; J. D. Lister

[57] ABSTRACT

An improved multiple article beverage package for cans or the like. The package is designed to contain a plurality of cans with the carrier being carried by a handle formed in the top panel of the carrier. An improved tear-out dispensing feature is provided in the subject package which is formed on one side of the package and is designed to be torn out of a portion of the side panels and a portion of the end closure flaps and to be folded downwardly to expose an immediately adjacent can within the package whenever the package is filled. The package also contains retaining means formed on the package for retaining the cans in the package after the tear-out dispenser feature has been opened so that only one can at a time may be removed without the remaining cans rolling out of the package by being forced out by the weight of cans positioned above the lower level of cans.

7 Claims, 3 Drawing Figures

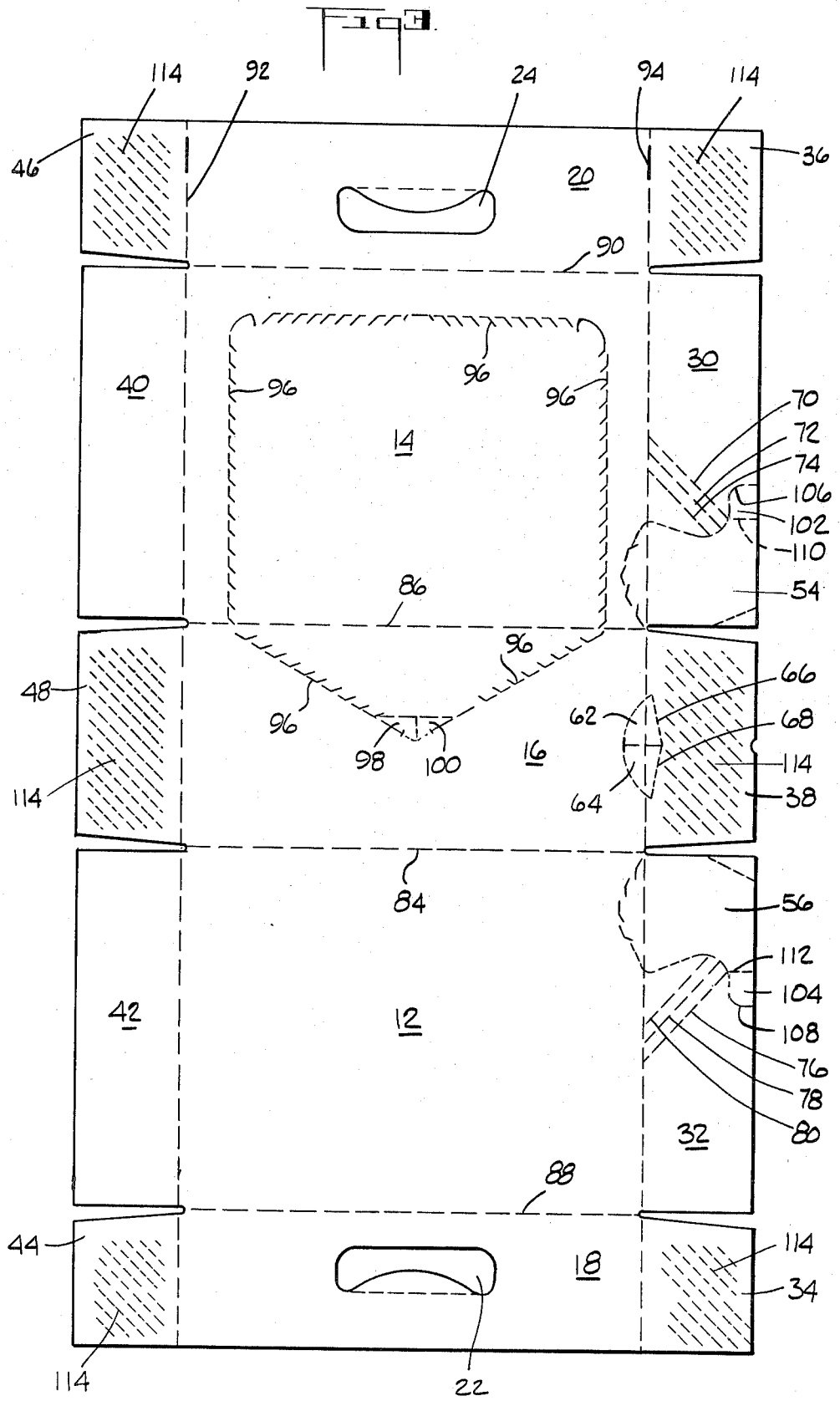
114
92
24
94
114
46
36
20
90
40
30
96
96
96
14
70
72
74
106
102
110
86
54
96
48
66
62
68
96
98
100
16
114
114
64
38
84
56
112
104
42
12
108
76
78
32
80
88
44
114
18
34
114
22

MULTIPLE ARTICLE BEVERAGE PACKAGE

BACKGROUND OF THE INVENTION

This invention relates to improved multiple article beverage packages and more important to an improved, glued can-type package carrier designed for carrying larger quantities of cans such as twelve cans more or less as shown in the preferred embodiment.

It is known in the art of beverage carrier packages to provide a package having a bottom panel, a pair of side panels and a top panel all hingedly attached together with a handle formed in the top panel of the carrier and with end closure flaps being formed on each end of the carrier. The end closure flaps may be locked together by locking and latching flaps as shown in the U.S. Pat. No. 3,894,681, issued July 15, 1975 to E. L. Arneson et al and assigned to Federal Paperboard Company, Inc.

It is also known to provide dispensing features in packages such as beforementioned which are designed to be torn out of the end closure flaps of the package and partly out of the sides of the package so that one can may be removed from the package at a time. Since the package contains several cylindrical shaped cans stacked on top of each other within the package, it is foreseeable that when the tear-out dispensing feature is torn out of the package, that more than one can would tend to roll out of the package unless some means were used to retain them in the package.

Accordingly, in the beforementioned reference U.S. Pat. No. 3,894,681, there is provided a downwardly depending single leg formed from the tear-out feature in the end closure flap of the package which is utilized to retain the cans in the package until they are removed one at a time.

Such a retaining means, while sufficient for a locked and latched type carton as typified in the cited reference, would not necessarily be satisfactory for the Applicant's type of package as shown in the preferred embodiment which is not a locked and latched package but is a glued package having glued end closure panels. After removal of several cans in the package of the type shown in the beforementioned cited reference, it can be seen that the downwardly depending leg can be bent upwardly and may tend to lose its holding ability for the remainder of cans in the package.

SUMMARY OF THE INVENTION

In order to overcome the beforementioned problems inherent in the beforementioned package, there has been provided by the subject invention an improved multiple article beverage package for cans or like designed to be retained in a glued package. The package has improved retaining means formed in the tear-out dispensing portion which provides a much stronger retaining means to more positively secure the cans in the package until removed one at a time. The Applicant's tear-out dispenser feature is formed in one side of the package in the preferred embodiment and has the end closure flaps adhesively secured together so that the bottom closure flap is positioned adjacent the side closure flaps and is adhesively secured thereto to provide a tray feature which is hingedly pivoted when the tear-out can dispensing feature is opened. The retaining means is formed on the package to retain the cans in the package after the tear-out dispenser feature has been opened so that only one can may be removed without the remaining cans rolling out of the package. The retaining means may comprise at least one downwardly depending leg formed on one of the side flaps and may also comprise an upwardly positioned retaining flap formed out of the bottom flap and a portion of the bottom panel and may also comprise a combination of these two features. A plurality of parallel score lines may also be formed on the downwardly depending leg to aid in removal of the can from the package without destroying the structural integrity of the retaining means. A centrally positioned finger hole punch-out feature is contained in the tear-out dispensing feature to easily be able to tear out the tray from the end closure flaps.

Accordingly, it is an object and advantage of the invention to provide a new and novel improved multiple article beverage package having a new and improved tear-out dispensing feature formed in the end closure flaps of a glued package.

Another object and advantage of the invention is to provide a new and improved multiple article beverage package having more positive means of retaining cans within the package whenever a tearout dispensing feature is activated and the feature is used many times without destroying the retaining capacity of the retaining feature built in to the package.

These and other objects and advantages of the invention will become apparent from a review of the drawings attached to the specification and from a study of the description of the preferred embodiment which is given by way of illustration only.

BRIEF DESCRIPTION OF THE DRAWINGS

FIG. 3 is a plan view of the production blank of the beverage package shown in FIGS. 1 and 2.

DESCRIPTION OF THE PREFERRED EMBODIMENT

Figure 1:
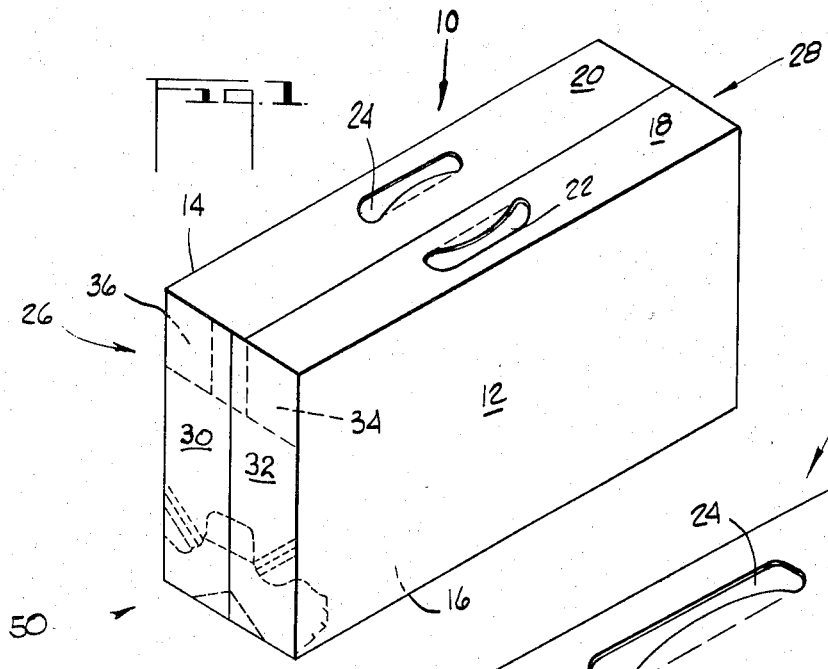
FIG. 1 is a perspective view of the Applicant's improved multiple article beverage package showing the package completely erected and glued together as it would appear in the retail outlet.
Figure 2:
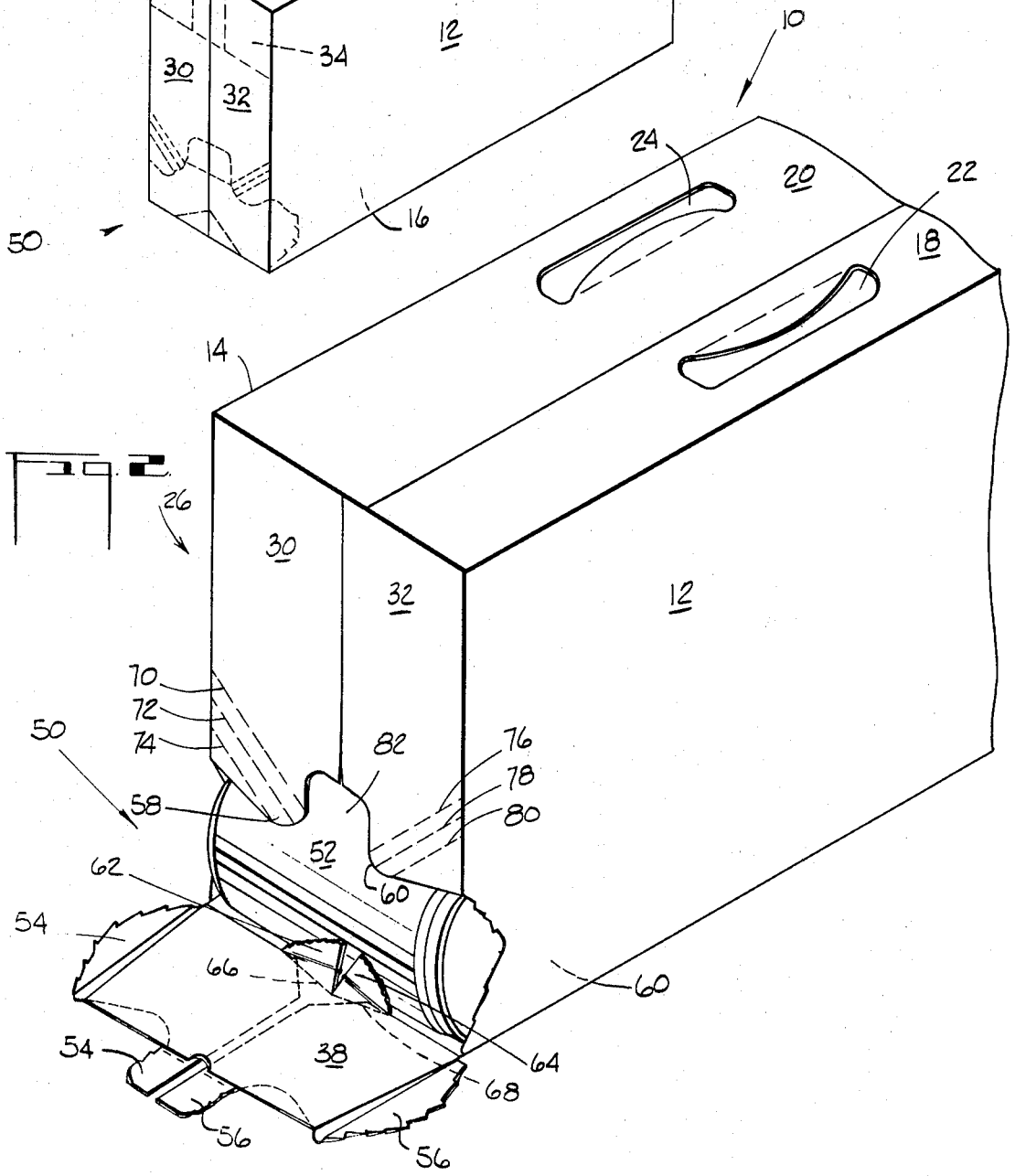
FIG. 2 is an enlarged perspective view of the multiple article beverage package shown in FIG. 1 showing the new and improved tear-out can dispensing tray feature of the Applicant's invention and also showing the retaining means for retaining the cans in the package after the tear-out dispenser feature has been opened.

Referring now to FIGS. 1 and 2 of the drawings, there is shown in detail the Applicant's new and improved multiple article beverage package shown generally by the numeral 10. The package comprises a side panel 12 and 14 hingedly attached to a bottom panel 16. A top panel is also hingedly attached to the side panels 12 and 14 and is formed out of two top panels 18 and 20 fixedly attached together by adhesive as is known in the art. The top panel has formed thereon handle means for carrying the package in the form of a plurality of handle openings 22 and 24 as is known in the art.

Each end of the package contains an end closure flap structure shown generally by the numeral 26 and 28 which is formed on each end of the package and is hingedly attached to the side panels and the top and bottom panels and is fixedly attached together by an adhesive. The end closure flap structure 26 comprises a left end closure flap 30 and a right end closure flap 32 as well as top end closure flaps 34 and 36 and a bottom end closure flap 38. The other end closure flap structure 28 would have a left end closure flap 40 as well as a right end closure flap 42 and a pair of top end closure flaps 44 and 46 as well as a bottom end closure flap 48. Several of the flaps beforementioned are not shown in FIGS. 1 and 2 and reference should be made to FIG. 3 showing a plan view of the production blank of the Applicant's package.

In the preferred embodiment, the end closure flap structures 26 and 28 on at least one side of the package are adhesively secured together so at least the bottom end closure flap 38 is positioned adjacent the left end closure flap 30 and the right end closure flap 32 and is adhesively secured thereto. In a like manner, the top end closure flaps 34 and 36 are adhesively secured also to the left and right end closure flaps 30 and 32.

Formed on the bottom portion of one side of the package is a tear-out, downwardly hinged, can dispensing tray feature shown generally by the numeral 50 which is formed on one side of the package and is designed to be torn out of a portion of the side panels 12 and 14 and a portion of the left and right end closure flaps 30 and 32 and to be folded downwardly to expose an immediately adjacent can 52 contained within the package 10. As has been beforementioned, the bottom end closure flap 38 is adhesively secured to the torn out portions 54 and 56 of the left end closure flap 30 and the right end closure flap 32.

It can be seen, especially by referring to FIG. 2, that the flap structure so formed and adhesively secured together serves as a tray upon which the cans 52 may roll over when removing them one at a time from the package. It should also be obvious from looking at FIG. 2 that some means must be provided to retain the cans in the package should it be desirable to remove them only one at a time since the weight of other cans piled on top of the lowermost can will tend to force the cans out of the package and they will all roll out at one time. Accordingly, there is also formed on the Applicant's package means for retaining the cans in the package after the tear-out dispenser feature has been opened so that only one can may be removed without the remaining cans being forced out of the package from the weight of successive cans placed on top thereof.

In the preferred embodiment, the retaining means may comprise at least one downwardly depending leg 58 and 60 formed on each side of the end flap structure. It can be seen at FIG. 2 that the left end closure flap contains one downwardly depending leg 58 while the right end closure flap 32 contains another downwardly depending leg 60. The retaining means may also comprise an upwardly positioned retaining flap 62 and 64 formed partly out of the bottom end closure flap 38 and partly out of the bottom panel 16. When formed thusly, the upwardly positioned retaining flap 62 and 64 may be bent upwardly by the purchaser along the score lines 66 and 68 to aid in retaining the can 52 in the package along with the downwardly depending leg 58 and/or the downwardly depending leg 60.

It may also be desirous to provide the end closure flap structure 26 with a plurality of score lines 70, 72 and 74 as well as a plurality of score lines 76, 78 and 80. It can be seen in referring to FIG. 2 that the left end closure flap 30 would contain the plurality of score lines 70, 72 and 74 while the right end closure flap 32 would contain the plurality of score lines 76, 78 and 80. The purpose of the score lines 70–80 would be to allow the legs 58 and 60 to be bent outwardly more easily thereby permitting an easier removal of the cans of the package. These score lines would permit a greater outward flexibility of the legs 58 and 60 which would tend to keep the legs from being permanently bent in an outward position when a can was removed. This feature would then tend to make the retaining feature last longer.

It may also be desirous in the package 10 to form in the end closure flap structure 26 a centrally positioned finger hole 82 which is formed as a punch-out feature in the tear-out dispensing feature for easily inserting a finger in the finger hole to start the tear-out feature along its pre-determined path.

Referring now to FIG. 3 of the drawing, there can be seen the plan view of the production blank of the Applicant's package which as has been beforementioned comprises the bottom panel 16 which is hingedly attached to side panels 12 by means of the score line 84 and to the side panel 14 by means of the score line 86. A top panel 18 is hingedly attached to the side panel 12 by means of the score line 88 while a top panel 20 is hingedly attached to the side panel 14 by means of the score line 90. An elongated score line 92 and 94 runs the entire longitudinal length of the production blank and divides the central panels from the flap structure formed on each side of the blank. For example, the score line 92 forms the hinged attachment for the top end closure flap 46, the left end closure flap 40, the bottom end closure flap 48, the right end closure flap 42 and the top end closure flap 44. In a similar manner, the score line 94 forms the hinged joint for the top end closure flap 36, the left end closure flap 30, the bottom end closure flap 38, the right end closure flap 32 and the top end closure flap 34.

It may also be desirous to have a further tear-out feature formed partially in the side panel 14 and partially in the bottom panel 16 by means of the partial die cuts 96 formed in the manner as shown thereby allowing a major portion of the entire side panel 14 to be removed to expose most of the cans in the package so that they may be emptied from the package totally at one time. This tear-out feature would be removed by punching in the finger tabs 98 and 100 and severing the major portion of the side panel 14 along the partial die cuts 96.

It can be seen also in FIG. 3 how the centrally positioned finger hole 82 is formed as a punch-out feature in the tear-out feature by the use of the finger tabs 102 and 104 formed in the left end closure flaps 30 and the right end closure flap 32. These tabs are formed by means of the curved score line 106 and 108 and the straight score line 110 and 112.

In order to aid the adhesively securing of the end flap structures together, there is provided on the top end closure flap 36 and 46 as well as the top end closure flap 34 and 44 along with the bottom end closure flap 38 and 48, an embossed area shown generally by the diagonally spaced dashed lines 114. The embossed area then aids in the adhesive securing to the various flaps since it provides a much greater area for the adhesive to secure itself to the adjacent flap.

From the foregoing it can be seen that there has been provided by the subject invention a new and improved multiple article beverage package for cans or the like having an improved tear-out dispensing feature formed on at least one side of the package. It is apparent from a review of the specification and a study of the drawing that many changes may be made in the various features of the Applicant's invention without departing from the spirit and scope of the invention and the invention is not to be limited to the exact features shown which have been shown by way of illustration only.

Having described my invention, I claim:

1. In a multiple article beverage package for cans or the like and of the type having a bottom panel, a pair of side panels hingedly attached to the bottom panel, a top panel structure hingedly attached to the side panels, the top panel structure having formed thereon handle means for carrying the package, the package also having an end closure flap structure formed on each end of the package and hingedly attached to the side panels and the top panel structure and the bottom panel and fixedly attached together, each end closure flap structure comprising a top flap and a bottom end closure flap and left and right end closure flaps, the improvement comprising:

(a) the end closure flap structure on at least one side of the package being adhesively secured together so that at least the bottom end closure flap is positioned adjacent the left and right end closure flaps and is adhesively secured thereto;

(b) a tear-out, downwardly hinged, can dispensing tray feature being formed on the same one side of the package and being designed to be torn out of a portion of the side panels and a portion of the left and right end closure flaps and to be folded downwardly to expose an immediately adjacent can within the package whenever the package is filled, the bottom end closure flap being adhesively secured to the torn-out portions of the left and right end closure flaps and serving as a tray upon which the cans may roll over when removing them one at a time from the package; and (c) means, formed on the package, for retaining the cans in the package after the tear-out dispenser feature has been opened so that one can may be removed at a time without the remaining cans being forced out of the package from the weight of successive cans placed on top of each other within the package, the retaining means comprising an upwardly positioned retaining flap formed partially out of the bottom end closure flap and partially out of a portion of the bottom panel.

2. The improvement as defined in claim 1 further comprising the retaining means comprising at least one downwardly depending leg formed on one end closure flap.

3. The improvement as defined in claim 2 further comprising the retaining means comprising a downwardly depending leg being formed on the other end closure flap.

4. The improvement as defined in claim 3 further comprising a centrally positioned finger hole punch-out feature being formed in the tear-out dispenser feature.

5. The improvement as defined in claim 2 further comprising a plurality of score lines being formed on the downwardly depending leg to allow the leg to be bent thereby permitting easier removal of the cans within the package.

6. The improvement as defined in claim 5 further comprising a centrally positioned finger hole punch-out feature being formed in the tear-out dispenser feature.

7. The improvement as defined in claim 1 further comprising a centrally positioned finger hole being formed as a punch-out feature in the tear-out dispenser feature for easily inserting a finger in the finger hole to start the tear-out feature along its predetermined tear-out path.

* * * * *